United States Patent [19]

Barker et al.

[11] 4,133,696

[45] Jan. 9, 1979

[54] SEPARATION OF SUGARS FROM MIXTURES

[75] Inventors: Sidney A. Barker; Peter J. Somers; Robin R. Woodbury, all of Birmingham, England

[73] Assignee: Imperial Chemical Industries Limited, London, England

[21] Appl. No.: 799,939

[22] Filed: May 24, 1977

[30] Foreign Application Priority Data

Jun. 16, 1976 [GB] United Kingdom ..... 24928/76

[51] Int. Cl.[2] ..... C13D 3/14; C13K 3/00

[52] U.S. Cl. ..... 127/46 A; 195/31 R; 195/31 F

[58] Field of Search ..... 127/46 R, 46 A, 46 B; 195/31 R, 31 F

[56] References Cited

U.S. PATENT DOCUMENTS

| | | | |
|---|---|---|---|
| 2,818,851 | 1/1958 | Khym | 127/46 A |
| 3,558,355 | 1/1971 | Kohno | 127/46 A |
| 3,689,362 | 9/1972 | Takasaki | 195/31 F |
| 3,784,409 | 1/1974 | Nelson | 127/46 A |
| 3,806,363 | 4/1974 | Takasaki | 127/46 A |
| 3,834,940 | 9/1974 | Khaleeluddin | 127/46 A |
| 3,864,166 | 2/1975 | Barker | 127/46 R |

*Primary Examiner*—Sidney Marantz

*Attorney, Agent, or Firm*—Cushman, Darby & Cushman

[57] ABSTRACT

A process for the treatment of a mixture comprising one or more sugars and oxyanions to separate a sugar or a sugar mixture therefrom wherein the ion-containing mixture is treated with an ion-exchange resin. The process may comprise treatment of the ion-containing mixture with a cationic exchange resin having thereon monovalent counterions or a mixture of divalent counterions and hydrogen ions or with first a cationic exchange resin having thereon hydrogen ions and then second with an anionic exchange resin having thereon monovalent or divalent counterions. The process is very useful in the production of fructose-containing syrups.

9 Claims, 9 Drawing Figures

SEPARATION OF SUGARS FROM MIXTURES

Figure 1:
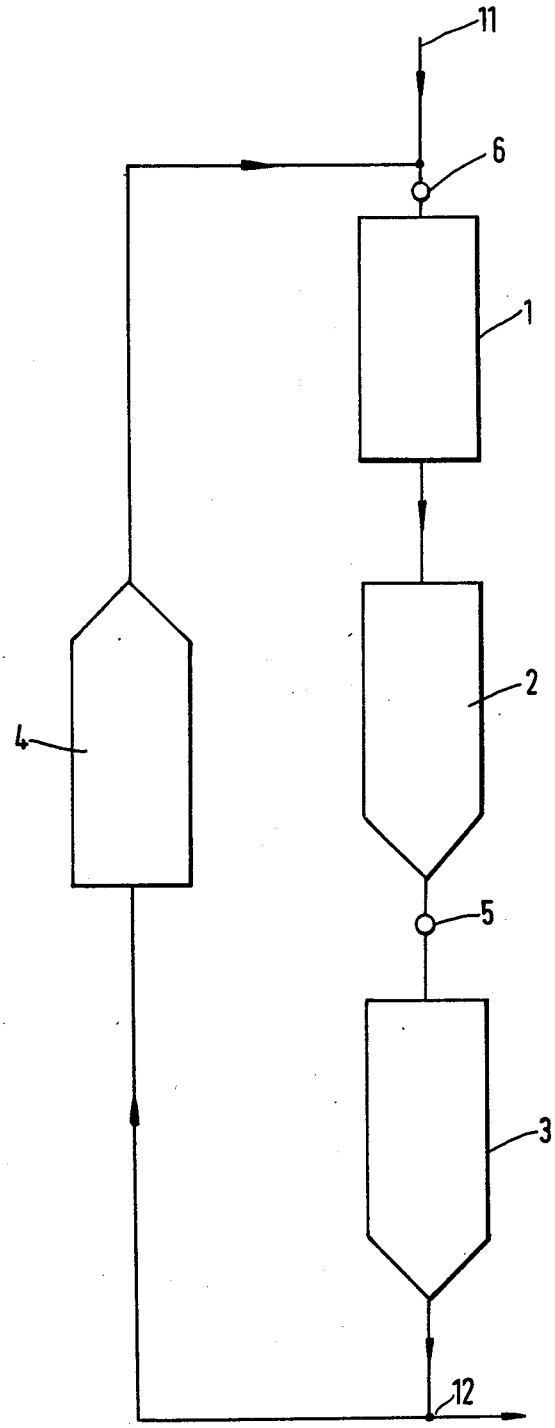

This invention relates to a process for the separation of a sugar or a mixture of sugars, in particular an aldose such as glucose or a ketose such as fructose or a mixture thereof, from an ion-containing mixture comprising the sugar or mixture of sugars and oxyanions (as hereinafter defined).

Several enzyme catalysed reactions involving carbohydrates are now known where the equilibrium position and hence the relative proportions of substrate and product in the equilibrium mixture are altered in the presence of oxyanions (as hereinafter defined). This alteration in the position of the equilibrium is related primarily to the selective formation of an anionic complex with either the substrate or the product. The formation of such a complex can sometimes be made quite specific by selection of an appropriate oxyanion and an alteration of pH that is compatible with the optimum pH of the enzyme. An example of this effect is the use of germanate ions in the glucose isomerase catalysed conversion of glucose to fructose described in our copending UK Application No. 25757/75. Another example is the use of borate ions in the same conversion as described in U.S. Pat. No. 3,689,362. The production of fructose using glucose isomerase is of major industrial importance but process development has been restricted to the reaction in the absence of an oxyanion because of the lack of an efficient and economic method of separating and recycling the oxyanion alone, complexed with or admixed with one of the carbohydrate components of the reaction mixture. Similar problems are encountered where the conversion of glucose to fructose is performed at an alkaline pH in the presence of an oxyanion such as that of benzeneboronate as described in UK Specification No. 1369175. Potentially important processes using molybdic acid to interconvert D-glucose and D-mannose or D-galactose and D-talose are not industrially economic, except for the supply of research chemicals, for the same reason.

According to the present invention we provide a process for the separation of a sugar or a mixture of sugars from an ion-containing mixture comprixing the sugar or mixture of sugars and oxyanions (as hereinafter defined) which comprises a step wherein the ion-containing mixture is treated in a system which includes an ion exchange resin as defined in (A) or (B) or a combination of ion exchange resins as defined in (C), (A) being a cationic exchange resin having thereon divalent cationic counterions admixed with hydrogen ions, (B) being a cationic exchange resin having thereon monovalent cationic counterions of which hydrogen ions, when present, form a minor proportion or, (C) first with a cationic exchange resin having thereon counterions all or a major proportion of which are hydrogen ions and second with an anionic exchange resin having thereon monovalent or divalent anionic counterions. In the process a sugar-oxyanion complex is removed by exclusion from the resin matrix, a sugar is removed by interaction with a resin component, or oxyanions are removed by interaction with the resin.

Further according to the invention we provide a process for the separation of a sugar or a mixture of sugars from an ion-containing mixture comprising the sugar or mixture of sugars and oxyanions (as hereinafter defined) which comprises a step in which the ion-containing mixture is treated with a cationic exchange resin having thereon cations chosen from divalent cationic counterions admixed with hydrogen ions or monovalent cationic counterions. In the process a sugar-oxyanion complex is removed by exclusion from the resin matrix or a sugar is removed by interaction with a resin component.

Further according to this invention we provide a process for the separation of a sugar or a mixture of sugars from an ion containing mixture comprising the sugar or mixture of sugars and oxyanions (as hereinafter defined) which comprises a step in which the ion containing mixture is treated first with a cationic exchange resin having thereon hydrogen ions and second with an anionic exchange resin having thereon anions chosen from carboxylic acid anions. In the process the oxyanions are removed by interaction with the anionic exchange resin.

In this specification the term oxyanions is to be understood to mean oxyanions, mixed complex oxyanions or oxyanions containing sugar, said oxyanions containing boron or an element belonging to any of groups IV, V or VI of the Periodic Table and having an atomic number of at least 14.

The sugar is suitably an aldose, a ketose, a neutral derivative of an aldose or a ketose and any mixture thereof. The process of the invention is very suitable for use in connection with processes for the conversion of aldoses to ketoses in the presence of oxyanions. Such conversions can be performed by chemical methods or enzymic methods. Examples of such conversions include the conversion of xylose to xylulose and, particularly, the conversion of glucose to fructose. When used in connection with such conversions the process of the present invention gives a satisfactory separation of the sugars from the oxyanions and sugar-oxyanion complexes.

Oxyanions which can usefully be separated from sugars by the process of the present invention include oxyanions containing tin, boron, molybdenum, tungsten and, particularly, germanium.

The ion exchange resin may be an anionic or a cationic exchange resin, either resin having thereon suitable counterions.

Any suitable cationic exchange resin may be employed for example a nuclearly carboxylated or a nuclearly sulphonated cross-linked polystyrene cation exchange resin, the nuclearly sulphonated resin being especially suitable. Examples of such suitable resins are Dowex 50 WX4 resin manufactured by Dow Chemical Company, USA, Zerolite 225 manufactured by Permutit Company, London and the equivalent "Lewatit" grade manufactured by Bayer Germany converted to the appropriate counterion forms.

Any suitable anionic exchange resin may be employed for example a quaternary ammonium anion exchanger matrix, suitably cross-linked. Examples of such suitable resins are Dowex 1 × 2 and 1 × 8 resins manufactured by Dow Chemical Company, USA and Amberlite 1.R.A. 400 manufactured by Rohm and Haas Company.

When a cationic exchange resin is used with monovalent counterions, the monovalent counterions are preferably $Na^+$ ions. If $H^+$ ions are present on the resin in addition to the $Na^+$ ions or other monovalent ions, it is better that they are present in a minor proportion, preferably the proportion of $H^+$ ions is kept to a minimum. When divalent counterions are on the resin, they are preferably admixed with $H^+$ ions in such proportions that the hydrogen ions are present in minor proportions. The remaining counterions are divalent ions that complex with one or more carbohydrate components of the mixture of sugars and oxyanions. Preferred divalent counterions are $Ca^{2+}$ ions.

When an anionic exchange resin is used the counterions are preferably carboxylic acid anions. Examples of suitable counterions include monovalent carboxylic acid anions, particularly formate ions and acetate ions, and divalent carboxylic anions such as succinate. Other suitable anionic counterions are anions derived from strong inorganic acids e.g. sulphate ions.

The process of the present invention is particularly suitable for use in connection with a process such as that described in our co-pending UK Application No. 25757/75 in which an aldose is converted to a ketose in the presence of oxyanions or mixed complex oxyanions of the elements germanium or tin. This conversion process is especially applicable to the conversion of glucose to fructose in the presence of germanate ions and the process of the present invention will be described in detail when used in connection with this conversion process.

Three embodiments of the present invention will be described for use in the treatment of the glucose/fructose/germanate mixture issuing from an enzyme reactor in a process according to co-pending Application No. 25757/75. These embodiments can be employed at temperatures falling within a wide range, such as between ambient temperature (e.g. 20° C.) and 85° C., preferably between ambient temperature and 60° C. Very convenient temperatures for operation are at the temperature of the enzyme reactor, e.g. 60° C., or at ambient temperature, e.g. 20° C. In each embodiment, product mixture from an enzyme reactor is supplied with or without prior ion exchange to a column containing the separating ion exchange resin in pulses, the optimum volume of product in any pulse and the optimum interval between successive pulses depending on the dimensions of the column of ion exchange resin. The percentage cross linking in the separating ion exchange resin is preferably 4% ($Ca^{++}/H^+$), 2% ($Na^+$) and 8% ($HCOO^-$ or $CH_3.COO^-$) for the various counterions.

In a first embodiment a cationic exchange resin having thereon $Ca^{2+}$ ions admixed with $H^+$ ions as counterions effects a separation into glucose plus germanate, which issues first from a column containing the cationic exchange resin when a pulse of the product mixture passes through the column, and fructose which issues second from the column. Surprisingly the complexing ability of $Ca^{2+}$ is sufficient to dissociate the complex between fructose and germanate only when $H^+$ ions are also present on the matrix. The glucose plus germanate fraction may be recycled into the feed for the process of co-pending Application No. 25757/75 whilst the fructose is taken off as the product of the combined processes. In operation $Na^+$ ions in the syrup from the enzyme reactor cause progressive loss of separation due to displacement of $Ca^{2+}$ and/or $H^+$ from the resin. This effect may be avoided by use of a prior deionising cation exchange resin in the $H^+$ form before the $Ca^{2+}/H^+$ resin. The sodium ions may be replaced in the recycled glucose plus germanate stream by passing this through a cationic exchange resin in the $Na^+$ form.

In a second embodiment a cationic exchange resin having thereon $Na^+$ ions effects a separation into fructose complexed with germanate which issues first and a glucose/fructose mixture, which issues second from a column containing the resin. The fructose accompanying the glucose is that which is uncomplexed with germanate in the enzyme reaction. Surprisingly the fructose/germanate complex is excluded from the resin matrix as a defined complex. In order to extract all the fructose produced by the process of co-pending Application No. 25757/75, the fructose plus germanate fraction may be treated according to the first embodiment to produce fructose and germanate, the latter being recycled to the enzyme reactor. When germanate is present in the enzyme reaction, the excess fructose obtained over a process operated in the absence of germanate, is recovered in the form of a defined complex of fructose with germanate.

In a third embodiment the pH of the product mixture from a glucose to fructose conversion in the presence of germanate ions is reduced to break down the fructose/-germanate complex. This can be done by passing the product continuously through a cationic exchange resin having thereon hydrogen ions. After treatment to break down the fructose/germanate complex, an anionic exchange resin having thereon formate, succinate or acetate ions as counterions effects a separation into glucose plus fructose, which issues first from a column containing this aninoic exchange resin when a pulse of the treated product mixture passes through the column, and germanate ions, either as such or as germanic acid, which issue second from the column. The germanate and germanic acid may be recycled to the enzyme reactor.

The three embodiments described specifically above are three main embodiments of the invention. Other embodiments and variations of the above embodiments are possible without departing from the invention. The three embodiments described above are illustrated in FIGS. 1 to 3 of the accompanying drawing which are schematic diagrams of possible forms of the process of the invention.

FIG. 1 shows a system comprising an enzyme reactor 1, a prior deionising cationic exchange resin in the $H^+$ form 2, a separation cationic exchange resin having mixed $Ca^{2+}$ and $H^+$ counterions 3 and a cationic exchange resin in the $Na^+$ form 4. In operation syrup containing glucose/fructose/germanate produced in enzyme reactor 1 passes to prior deionising resin 2 in pulses. Treatment with prior deionising resin 2 replaces $Na^+$ ions in the product of reactor 1. From prior deionising resin 2 pulses of syrup pass via pH monitor 5 (whose function is described below) to separation resin 3. From separation resin 3 a glucose plus germanate fraction elutes first and a fructose fraction second. The fructose fraction is removed from the system at 12 as product. Some $Ca^{2+}$ ions are eluted before the glucose plus germanate fraction and are removed. The extent to which $Ca^{2+}$ ions are eluted, which is related to the low pH generated in the output from prior deionising resin 2, can be minimised by selective cutting of the acid fraction. The glucose plus germanate fraction passes from separation resin 3 to $Na^+$ form resin 4 to replace $H^+$ ions in the stream by $Na^+$ ions. Thus when resin 4 is exhausted it is interchangeable with resin 1. After passing through resin 4 the glucose plus germanate fraction is returned to enzyme reactor 1 via pH adjustment station 6 at which the pH is adjusted to the correct value for the process of co-pending Application No. 25757/75. Glucose feed is introduced into the system at 11.

Figure 2:
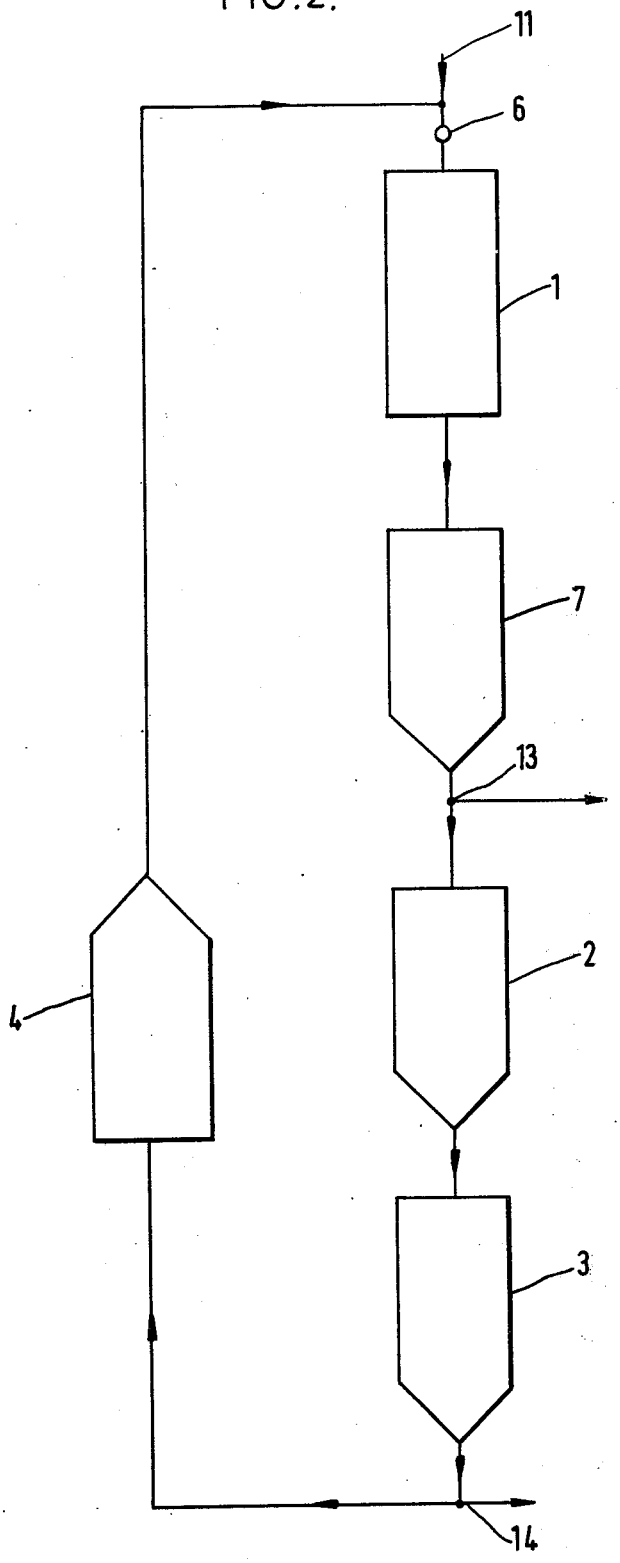

FIG. 2 shows a system having the same integers as are shown in FIG. 1 but with the omission of pH monitor 5. In the system of FIG. 2 however there is interposed between enzyme reactor 1 and prior deionising resin 2 an alternative separation resin 7 in the $Na^+$ form. This resin effects a separation between fructose complexed with germanate, which is eluted first and is thereafter treated in the same manner as the reactor product as a whole is treated by the system of FIG. 1, and a mixture of glucose and fructose which is removed at 13 as a product. The fructose complexed with germanate fraction is separated by separation resin 3 into germanate, which is eluted first and is then recycled as in the system of FIG. 1, and fructose which is removed at 14 as a product.

Figure 3:
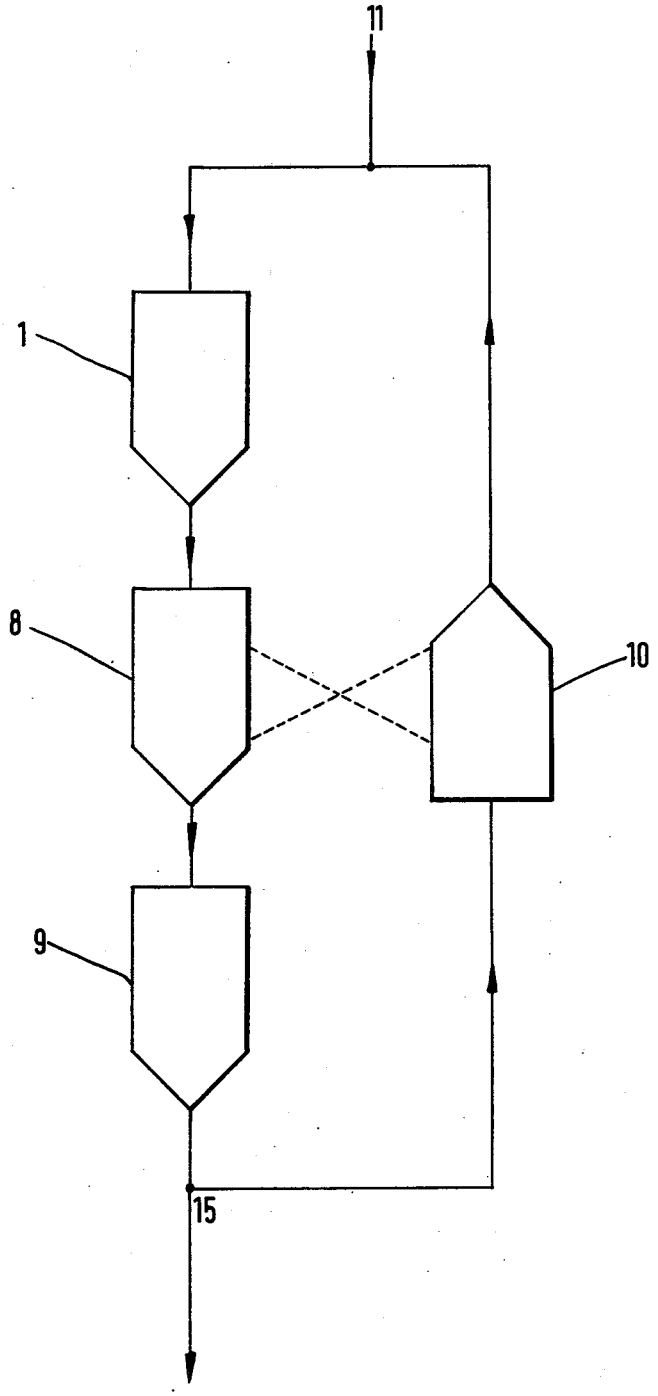

FIG. 3 shows a system for the operation of the third embodiment described above. The system comprises enzyme reactor 1, ($H^+$) form cation exchanger 8, formate, succinate or acetate form anion exchanger 9 and ($Na^+$) form cation exchanger 10. In operation, syrup containing glucose/fructose/germanate produced in enzyme reactor 1 passes, either continuously or in pulses, through ($H^+$) form cation exchanger 8. It then passes in pulses through anion exchanger 9. From anion exchanger 9 a syrup containing glucose and fructose elutes first and is removed from the system at 15 as product. A germanate containing fraction which elutes second from anion exchanger 9 is recycled, via ($Na^+$) form cation exchanger 10 to enzyme reactor 1. When ($Na^+$) form cation exchanger 10 becomes exhausted, it is interchangeable with ($H^+$) form cation exchanger 8.

In the three embodiments outlined above and recycled feed can be constituted in a number of ways.

a. Embodiment 1 offers a diluted glucose-germanate mixture that can be enriched with solid glucose or concentrated prior to mixing with concentrated glucose syrup and subsequent pH adjustment.

b. Embodiment 2 offers a diluted sodium germanate solution with minor contaminants that can be concentrated prior to mixing with glucose syrup or addition of solid glucose.

c. Embodiment 3 offers a diluted sodium germanate solution with minor contaminants that can be treated as in (b).

d. Embodiment 3 also offers the opportunity to dispense with the final $Na^+$ form column and concentrate what is effectively a solution of germanic acid that will, in the process of concentration, precipitate out solid germanium oxide in a form suitable for mixing with a glucose feed syrup or solid glucose with appropriate pH adjustment.

In (a)–(d) any trace ions such as magnesium or even cobalt will be adjusted to their requisite levels in the recycled feed. In embodiments 1, 2 and 3 the glucose syrup may be replaced by a syrup partially converted to fructose. The preferred molar concentration of the germanate is half that of the total sugar molarity at any time during the conversion. Because of the high molar concentration of the germanate ions constantly passing through the formate or acetate columns, some replacement of these ions by germanate containing ions may occur.

The three embodiments illustrate the three approaches to the separation of a sugar or a mixture of sugars from an ion-containing mixture comprising the sugar or mixture of sugars and oxyanions, namely Embodiment 1 illustrates removal of the sugar by interaction with a resin component, e.g. $Ca^{++}$ ions.

Embodiment 2 illustrates removal of the sugar-oxyanion complex by exclusion from the resin matrix.

Embodiment 3 illustrates removal of the oxyanion by prior interaction with resin bound $H^+$ followed by interaction with a resin component.

Embodiments 1 and 3 could be operated with columns 2 and 3 or 8 and 9 as single columns containing both resins in a suitable configuration.

The three embodiments described above could be adapted for the same types of columns receiving a continuous rather than a pulsed feed and/or where the separation is achieved continuously as per the technique of P. E. Barker and R. E. Deeble, (Chromatographia, Vol. 8, 1975, p 67–9 and BP 141850). Also a cycling system can be used and the procedure outlined by Simpson and Bauman (Ind. & Eng. Chem., 46, 1958–62, 1954) adapted to it.

The invention is illustrated by the following Examples:

EXAMPLE 1

The following separations were carried out on a column (length 71 cm, diameter 1.5 cm) packed with "Lewatit" cationic exchange resin (Bayer, W. Germany) and having thereon as counterions ($Ca^{2+}$) and ($H^+$) ions, regenerated from the ($H^+$) form by treatment with $CaCl_2.6H_2O$, 10% w/v:

a. glucose and fructose from a mixture thereof
b. glucose/germanate and fructose from a mixture comprising 25% w/v glucose, 25% w/v fructose and 600 mM germanate in water at pH 8.5.
c. glucose and fructose from a mixture thereof.

A flow rate of 0.6 mls/min was employed at 60° C. and sequential pulses of carbohydrate syrup (2 mls) applied at 65 min intervals. The separations were performed sequentially, separation (b) being performed twice. All separations were successful, the eluate from the column being passed into an autoanalyser for assay of carbohydrate, fructose and germanate. Analysis showed that an excellent separation of peaks was being achieved. In separation (b) glucose/germanate was eluted from the column first with germanate slightly preceding the glucose. Similar results were obtained when "Lewatit" was replaced by "Dowex" 50 WX4 or Zerolite 225. Carbohydrate was assayed using cysteine-sulphuric acid, fructose with carminic acid-sulphuric.

EXAMPLE 2

The glucose/fructose/600 mM germanate eluate from an enzyme reactor operating the process of copending Application No. 25757/75 was pulsed on to two columns containing "Lewatit" resin in sequence. The first column (bed volume = 70 ml) contained the resin in ($H^+$) form and absorbed interfering ($Na^+$) ions for the syrup eluted from the enzyme reactor. After passing through the first column the eluate syrup passed onto a second column which was the same as that used in Example 1. The second column effected the separation of glucose/germanate from fructose continuously for a prolonged period without regeneration (tested for 10 pulses each of 5 ml syrup onto the first column and one-quarter taken continuously for separation onto the second column). A last pulse of 10 ml syrup was excellently separated and was analysed chromatographically both on emerging from the first column and the second column. The chromatographic results obtained showed that hydrogen ions were displaced from the first column and that they displaced ($Ca^{2+}$) ions as they passed down the resin in the second column, the displaced ($Ca^{2+}$) ions being in advance and clearly separable from an overlapping sequence of germanate and glucose. This overlapping sequence was clearly separated from the product fructose.

EXAMPLE 3

A column (140 cm length × 6mm internal diameter) containing "Lewatit" resin in the ($Na^+$) form was used to separate the product from a germanate catalysed glucose isomerase reactor, the product being pulsed continuously onto the column. Good separation was maintained over 20 pulses of 0.25 ml. The eluate from the column was examined chromatographically and the first peak was found to be mainly fructose plus all the germanate while the second peak was fructose 26.71 to glucose 28.98. These two major peaks showed excellent separation.

EXAMPLE 4

A column (140 cms length × 4 mm internal diameter) containing "Lewatit" resin in the ($Na^+$) form was used to fractionate a sample consisting of glucose(0.74 M), fructose(0.74 M), and borate (1.1 M with respect to boron, derived from $B_2O_3$) adjusted to pH 8.5. Good separations were obtained into two components with sample loading of 0.25 ml. The first peak eluted consisted of mainly fructose and all the borate whilst the second peak consisted mainly of glucose.

EXAMPLE 5

This example describes six experiments A to F in which reactor syrup produced using the process of co-pending UK Application No. 25757/75 and containing glucose, fructose and germanate was passed through columns containing ion exchange resins. The separations achieved are illustrated in FIGS. 4 to 9 of the drawings. In each figure the plots for glucose, fructose and germanate are represented as follows:

| | |
|---|---|
| ..... | Germanate |
| — — — — — — — — | Fructose |
| ———————— | Glucose |

The analytical methods used were:
Germanate — carminic acid — sulphuric acid
Fructose — resorcinol — hydrochloric acid
Glucose — glucose oxidase

EXPERIMENT A

Use of anionic exchange resin with acetate counterions

Column — 39 × 0.6 cms
Resin — "DOWEX" 1 × 8, 200–400 mesh
Elution with water at 0.33 $cms^3$ $min^{-1}$
Temperature — 40° C.
Load — reactor syrup after passage through a cationic exchange resin in the $H^+$ form.

Figure 4:
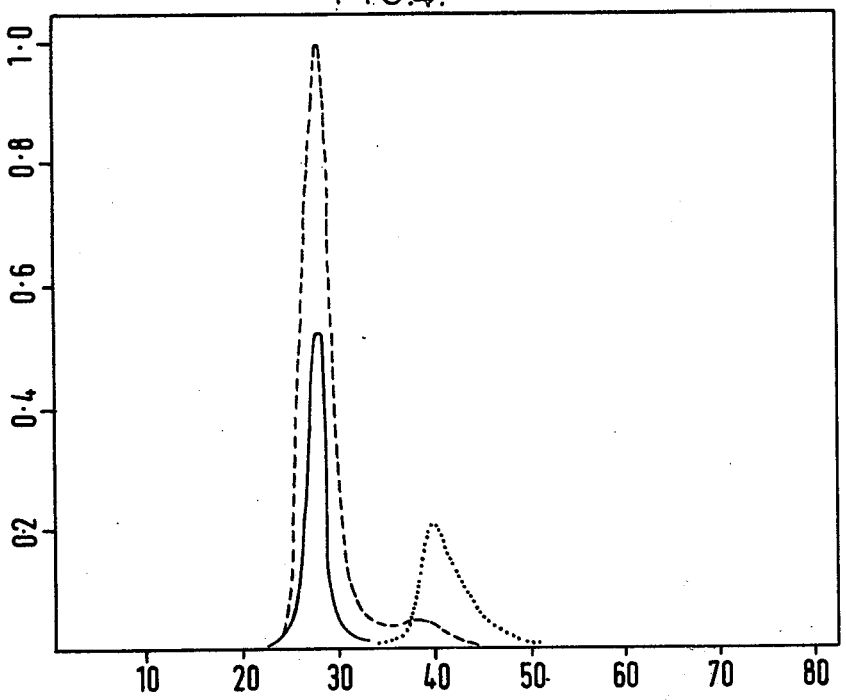

The separation achieved is illustrated in FIG. 4 which polts absorbance at specified wavelengths, characteristics of the particular component, in the respective analyses, in the visible region (ordinate) against time of elution from column in minutes (absissa). As can be seen glucose and fructose elute from the column together, before and quite separately from germanate.

EXPERIMENT B

Use of anionic exchange resin with formate counterions

Figure 5:
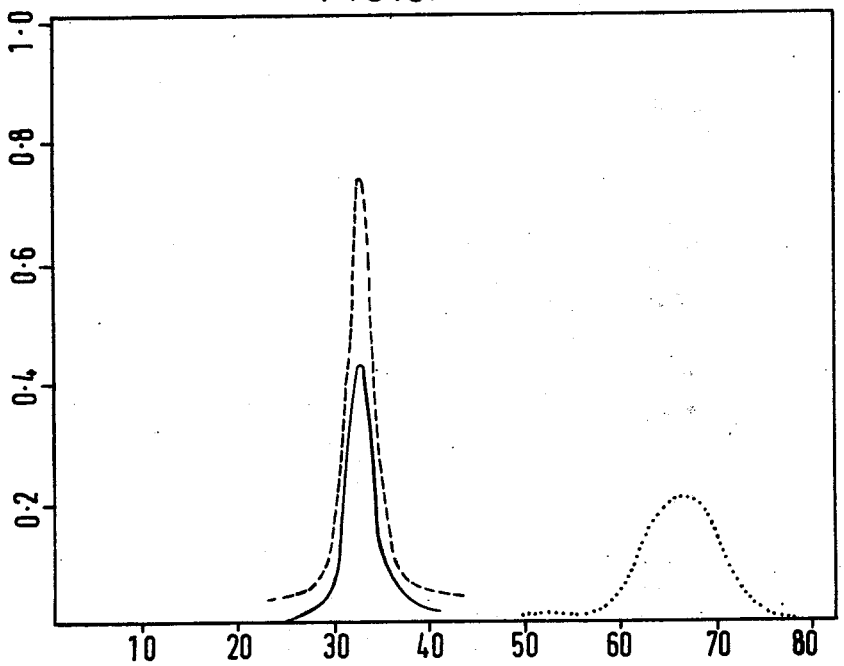

Reaction conditions as in Experiment A. The Results are shown in FIG. 5, whose ordinate and absissa represent the same parameters as they do in Experiment A. Using succinate as a counterion in a similar experiment the separation was intermediate between that obtained in Experiments A and B.

EXPERIMENT C

Use of cationic exchange resin with $Ca^{2+}$ counterions

Column — 131 × 0.6 cm
Resin — "LEWATIT" cation exchanger, regenerated at 60° C. with a solution of CaO(3.9% w/v) adjusted to pH 8 with HCl.
Elution with water at 0.33 $cms^3$ $min^{-1}$.
Temperature — 20° C.
Load — 100 μl reactor syrup, (after passage through a cation exchange resin in the ($H^+$) form) containing 32.7% w/v fructose, 1.6% w/v glucose and 0.1 M with respect to germanium.

Figure 6:
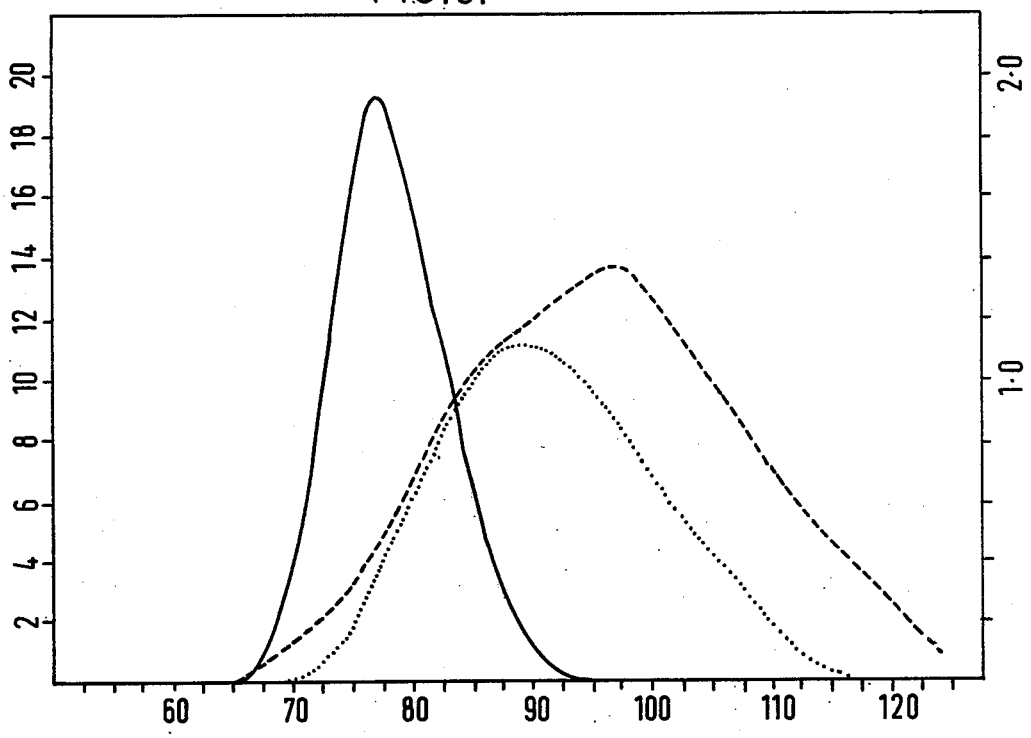

The separation achieved is illustrated in FIG. 6 in which the co-ordinates are:
Left hand ordinate — μ moles fructose
Right hand ordinate — μ moles (glucose or germanate)
Absissa — time of elution (minutes)

EXPERIMENT D

Use of cationic exchange resin with $Ca^{2+}$ and $H^+$ counterions

Column — 131 × 0.6 cm
Resin — "LEWATIT" cation exchanger, regenerated with $CaCl_2 . 6H_2O$, 10% w/v.
Elution with water at 0.33 $cm^3$ $min^{-1}$
Load — 50 μl reactor syrup containing 36.3% w/v fructose, 2.7% w/v glucose, 1.2 M with respect to germanium.

Figure 7:
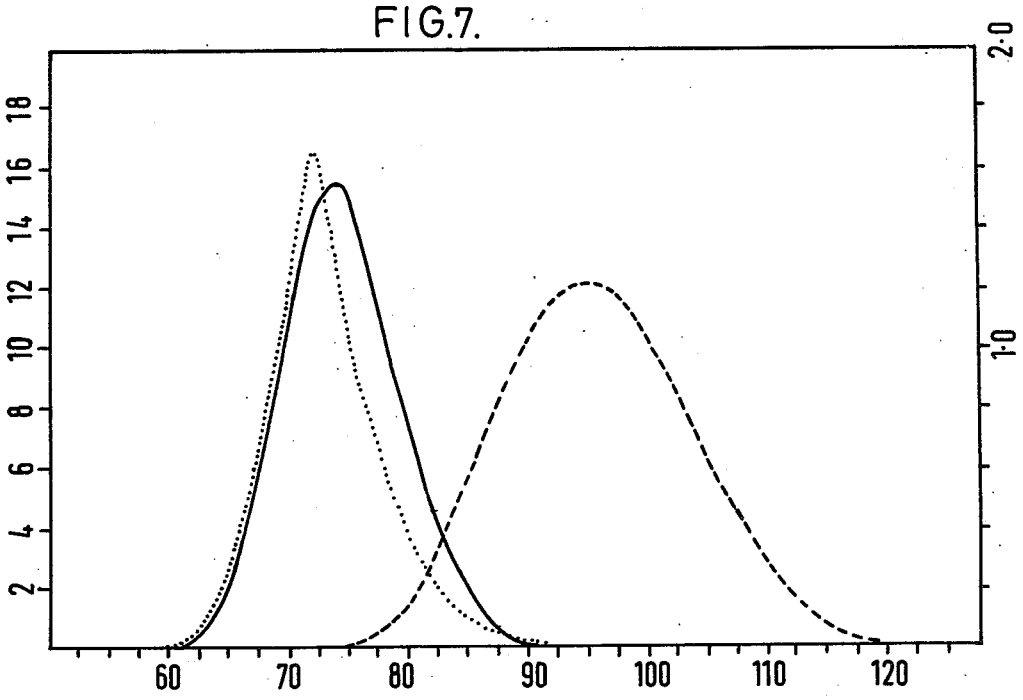

The separation achieved is illustrated in FIG. 7 in which the co-ordinates are:
Left hand ordinate — μ moles (fructose or germanate)
Right hand ordinate — μ moles (glucose)
Absissa — time of elution (minutes)

As can be seen from FIG. 7 the use of ($Ca^{2+}$) ions together with ($H^+$) ions as counterions gives a separation of germanate from fructose, the fructose being retarded by interaction with the resin. Importantly, as seen in FIG. 6, the fructose germanate complex is not resolved when an acidified sample is fractionated on a column containing only ($Ca^{2+}$) counterions.

EXPERIMENT E

Use of cationic exchange resin with $Na^+$ & $H^+$ counterions

Figure 8:
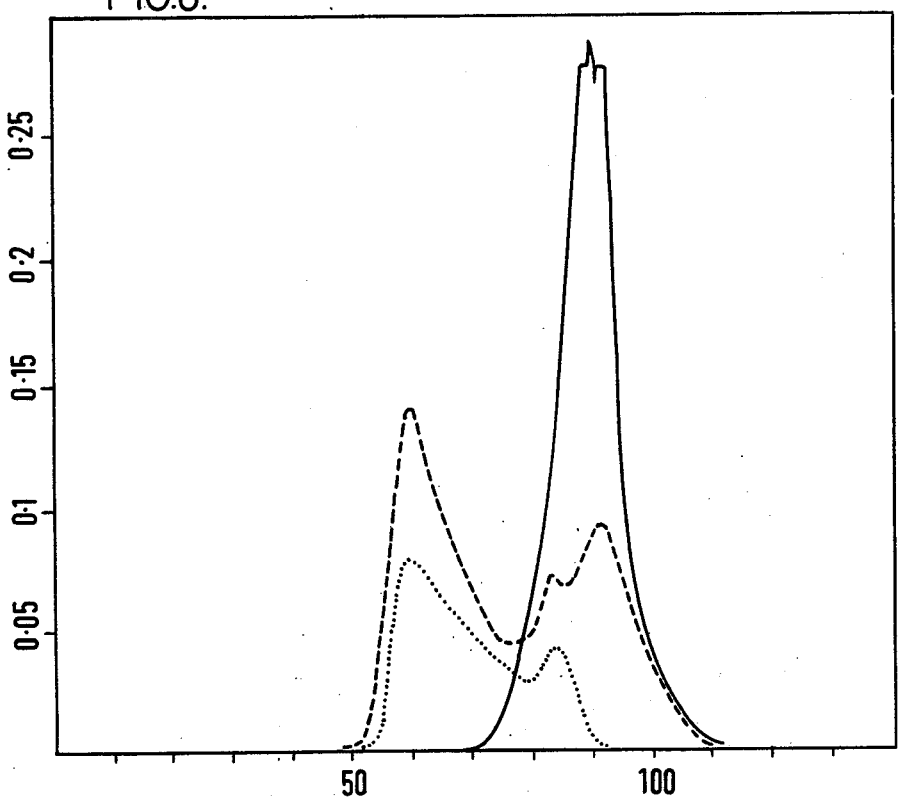

Column — 130 × 0.6 cm
Resin — AG 50 W × 2, regenerated with NaCl, adjusted to pH 4.0 with HCl.
Elution with water at 0.37 $cms^3$ $min^{-1}$
Temperature — 20° C.
Load — 500 μl reactor syrup containing 28% w/v glucose, 25% w/v fructose, 0.6 M with respect to germanium The separation achieved is illustrated in FIG. 8 in which the ordinate represents millimoles of component and the absissa time in minutes of elution from the column.

temperature dependent, a greater proportion of uncomplexed fructose being obtained at higher temperatures.

TABLE 1

Separation parameters for the resolution of fructose-germanate from fructose and glucose on AG 50W cation exchange resin, ($Na^+$) form.

| Cross Linking (% DVB) | Temperature (° C) | Sample Load(μl) | $Rf^+$ Peak I | $Rf^+$ Peak II | Ratio of complexed: uncomplexed fructose |
|---|---|---|---|---|---|
| 2 | 20 | 10 | 0.44 | 0.83 | 0.42 |
| 2 | 20 | 50 | 0.39 | 0.83 | 0.86 |
| 2 | 20 | 100 | 0.42 | 0.85 | 1.10 |
| 2 | 20 | 500 | 0.44 | 0.89 | 2.25 |
| 2 | 20 | 1000 | 0.45 | 0.92 | 1.93 |
| 2 | 40 | 500 | 0.42 | 0.73 | 1.57 |
| 2 | 60 | 500 | 0.49 | 0.84 | 1.30 |
| 2 | 70 | 500 | 0.51 | 0.81 | 1.04 |
| 2 | 85 | 500 | 0.53 | 0.88 | 0.64 |
| 4 | 20 | 500 | 0.45 | 0.89 | 1.71 |
| 4 | 20 | 1000 | 0.45 | 0.88 | 1.80 |
| 4 | 60 | 500 | 0.47 | 0.83 | 1.29 |
| 4 | 60 | 1000 | 0.53 | 0.83 | 1.34 |
| 8 | 20 | 1000 | * | * | * |
| 12 | 20 | 1000 | | | |

* No resulution of complexed and uncomplexed fructose.
[30] Rf = Retention factor as defined in S A Barker, B W Hall, J F Kennedy and P J Somers; Carbohydrate Research, 9 (1969) 327.

EXPERIMENT F

Use of cationic exchange resin with $Na^+$ counterions

The reaction conditions were the same as for Experiment E except that the load was 500 μl reactor syrup containing 20% w/v glucose, 30% w/v fructose and 0.6 M with respect to germanium, and the resin was regenerated with NaOH (1.0 M).

Figure 9:
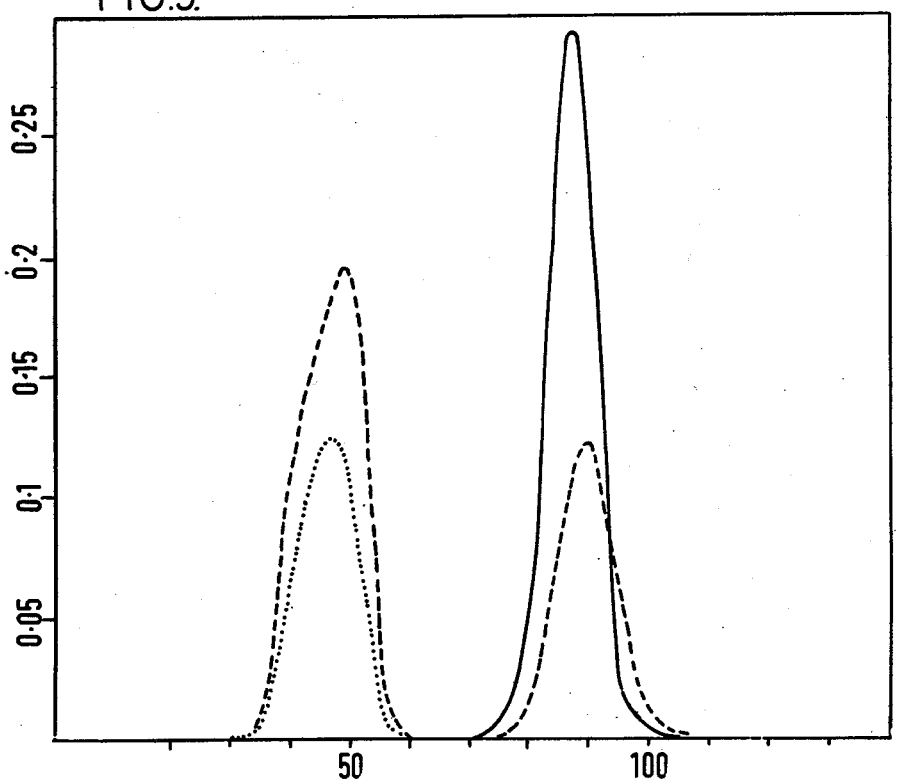

The separation achieved is illustrated in FIG. 9 whose coordinates are the same as those of FIG. 8. As can be seen from FIGS. 8 and 9, the presence of both $H^+$ and $Na^+$ ions on the same resin results in an imcomplete resolution of the fructose-germanate complex whereas with only $Na^+$ ions on the resin a completely resolved fructose-germanate component is obtained.

EXAMPLE 6

A column of cation exchange resin (BIORAD) AG 50W, 200–400 mesh, 2–12% crosslinkage, was converted to the ($Na^+$) form by washing with NaOH (2N) followed by distilled water and packed into columns (130 × 0.7 cm). Elution was with distilled water (0.37 $cm^3$ $min^{-1}$) and the column maintained at 20°–85° C. The column eluate was monitored by the conventional glucose oxidase, resorcinol and carminic acid analysis methods for glucose, fructose and germanate respectively. The sample loads were all derived from an enzyme reactor product consisting of fructose (30% w/v), glucose (20% w/v) and germanate (0.6 M w.r.t Ge) pH 8.5 containing $MgCl_2$ (4 mM). The effect of sample load, temperature and percentage divinylbenzene (DVB) crosslinking are shown in Table 1.

Good separations are obtained between fructose-germanate complex (peak I) and uncomplexed fructose and glucose (peak II) on the 2% DVB cross-linked matrix, considerably better than on a 4% DVB crosslinked matrix. Increase in crosslinking to 8 or 12% DVB gives incomplete resolution of the complexed and uncomplexed fructose.

At low sample loads some degeneration of resolution occurs, and the ratio of fructose complexed to uncomplexed is sample load dependent. At loads of ca. 500 μl virtually theoretical compositions of fructose-germanate complex are excluded from the matrix. The ratio of complexed fructose to uncomplexed fructose is also

EXAMPLE 7

A column (135 × 0.6 cm) containing "Lewatit" cation exchange resin in the ($Ca^{++}/H^+$) form, (regenerated from the ($H^+$) form by treatment with $CaCl_2 \cdot 6H_2O$, 10% w/v) was eluted with water at 0.32 $cm^3$ $min^{-1}$ at ambient temperature. A good separation of a sample (25 μl) of a product from a glucose isomerase reactor operating on a feed of glucose (40% w/v) containing $Na_2B_4O_7 \cdot 10H_2O$ (0.6 M w.r.t. boron) and $MgCl_2$ (4 mM), adjusted to pH 9.0, was achieved. Glucose was eluted first (Rf 0.55), followed closely by borate (Rf 0.61), and finally fructose (Rf 0.73).

EXAMPLE 8

A column (140 × 0.6 cm) containing "Lewatit" resin in the ($Na^+$) form was eluted with water at 0.32 $cm^3$ $min^{-1}$ at ambient temperature. A good separation of complexed and uncomplexed sugars were obtained with a sample (0.25 $cm^3$) of the product of a glucose isomerase reactor operating on a feed of glucose (30% w/v) containing $Na_2B_4O_7 \cdot 10H_2O$ (0.6 M w.r.t. boron) and $MgCl_2$ (4 mM), adjusted to pH 7.5. Glucose-borate and fructose-borate (Rf 0.39) are eluted first, followed by glucose (Rf 0.62) and fructose (Rf 0.67).

We claim:

1. A process for the separation of a sugar or a mixture of sugars from an ion-containing mixture comprising said sugar or mixture of sugars and oxyanions, said ion-containing mixture produced in a process for converting an aldose to a ketose in the presence of oxyanions, which comprises a step wherein the ion-containing mixture is contacted with:

(A) a cationic exchange resin having thereon divalent cationic counterions admixed with hydrogen ions; or (B) a cationic exchange resin having thereon monovalent cationic counterions of which hydrogen ions, when present, form a minor proportion; or (C) first with a cationic exchange resin having thereon counterions all or a major proportion of which are hydrogen ions and second with an anionic exchange resin having thereon monovalent or divalent anionic counterions.

2. A process for the separation of a sugar or a mixture of sugars from an ion-containing mixture comprising said sugar or mixture of sugars and oxyanions, said ion-containing mixture produced in a process for converting an aldose to a ketose in the presence of oxyanions, which comprises a step in which the ion-containing mixture is treated with a cationic resin having thereon cations chosen from divalent cationic counterions admixed with hydrogen ions or monovalent cationic counterions.

3. A process for the separation of a sugar or mixture of sugars from an ion-containing mixture comprising said sugar or mixture of sugars and oxyanions, said ion-containing mixture produced in a process for converting an aldose to a ketose in the presence of oxyanions, which comprises a step wherein the ion-containing mixture is treated first with a cationic exchange resin having thereon hydrogen ions and second with an anionic exchange resin having thereon carboxylic acid anions.

4. A process according to claim 1 wherein glucose, fructose or a mixture thereof is separated from an ion-containing mixture comprising glucose, fructose and oxyanions.

5. A process according to claim 1 wherein the oxyanions contain boron or germanium.

6. A process according to claim 2 wherein the cationic exchange resin is a nuclearly carboxylated or a nuclearly sulphonated cationic exchange resin and comprises a cross-linked matrix.

7. A process according to claim 2 wherein the cationic exchange resin has on it calcium ions admixed with hydrogen ions or has on it sodium ions as counterions.

8. A process according to claim 3 wherein the anionic exchange resin is a quaternary ammonium resin having a cross-linked matrix.

9. A process according to claim 3 wherein the carboxylic acid anions are formate, acetate or succinate ions.

* * * * *